US010814630B2

(12) United States Patent
Hirata et al.

(10) Patent No.: US 10,814,630 B2
(45) Date of Patent: Oct. 27, 2020

(54) JET HOLE PLATE, LIQUID JET HEAD, LIQUID JET RECORDING APPARATUS, AND METHOD FOR MANUFACTURING JET HOLE PLATE

(71) Applicant: SII Printek Inc., Chiba-shi, Chiba (JP)

(72) Inventors: Masakazu Hirata, Chiba (JP); Kenji Takano, Chiba (JP); Tomoki Sodetai, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/189,290

(22) Filed: Nov. 13, 2018

(65) Prior Publication Data

US 2019/0143692 A1 May 16, 2019

(30) Foreign Application Priority Data

Nov. 14, 2017 (JP) ..... 2017-218696

(51) Int. Cl.
*B41J 2/16* (2006.01)
*B41J 2/14* (2006.01)

(52) U.S. Cl.
CPC ..... *B41J 2/162* (2013.01); *B41J 2/1433* (2013.01); *B41J 2/14209* (2013.01); *B41J 2/1606* (2013.01); *B41J 2/1609* (2013.01); *B41J 2/1623* (2013.01); *B41J 2/1632* (2013.01); *B41J 2/1643* (2013.01); *B41J 2202/11* (2013.01); *B41J 2202/12* (2013.01)

(58) Field of Classification Search
CPC ..... B41J 2/1433
See application file for complete search history.

(56) References Cited

U.S. PATENT DOCUMENTS 5,434,606 A * 7/1995 Hindagolla ..... B41J 2/1606 347/45
6,170,934 B1 1/2001 Fukisawa et al.
2006/0066691 A1* 3/2006 Sakaida ..... B41J 2/14209 347/71
2008/0150998 A1* 6/2008 Okamura ..... B41J 2/1606 347/30
2010/0053269 A1 3/2010 Fujii et al.
(Continued)

FOREIGN PATENT DOCUMENTS

JP H05-155028 A 6/1993
JP H10-226070 A 8/1998
JP 2004-255696 A 9/2004

OTHER PUBLICATIONS

Extended European Search Report in Europe Application No. 18206312.3, dated Mar. 29, 2019, 8 pages.

*Primary Examiner* — Shelby L Fidler
(74) *Attorney, Agent, or Firm* — Brinks Gilson & Lione

(57) ABSTRACT

Provided herein are a jet hole plate, a liquid jet head, a liquid jet recording apparatus, and a method for manufacturing a jet hole plate that can achieve a long life. A jet hole plate according to an embodiment of the present disclosure is a jet hole plate for use in a liquid jet head. The jet hole plate includes a metal substrate having provided therein a plurality of jet holes. The metal substrate has a principal surface having outlets for the jet holes. The principal surface has a surface roughness (arithmetic mean roughness Ra) that is smaller in outlet edge regions of the jet holes than in surrounding regions around the outlet edge regions.

9 Claims, 11 Drawing Sheets

(56) References Cited

U.S. PATENT DOCUMENTS

| | | | | |
|---|---|---|---|---|
| 2013/0050341 | A1* | 2/2013 | Cringus | B41J 2/1433 347/45 |
| 2014/0035998 | A1* | 2/2014 | Veis | B41J 2/1433 347/47 |
| 2014/0055527 | A1 | 2/2014 | Hashimoto | |
| 2014/0085380 | A1* | 3/2014 | Uno | B41J 2/14233 347/45 |
| 2016/0207311 | A1 | 7/2016 | Tamai et al. | |

* cited by examiner

JET HOLE PLATE, LIQUID JET HEAD, LIQUID JET RECORDING APPARATUS, AND METHOD FOR MANUFACTURING JET HOLE PLATE

RELATED APPLICATIONS

This application claims priority under 35 U.S.C. § 119 to Japanese Patent Application No. 2017-218696 filed on Nov. 14, 2017, the entire content of which is hereby incorporated by reference.

BACKGROUND OF THE INVENTION

1. Field of the Invention

The present disclosure relates to a jet hole plate, a liquid jet head, a liquid jet recording apparatus, and a method for manufacturing a jet hole plate.

2. Description of the Related Art

A liquid jet recording apparatus equipped with a liquid jet head is in wide use. A liquid jet head includes a plurality of laminated plates including a jet hole plate having formed therein large numbers of jet holes, and is configured to eject liquid, specifically, ink, against a target recording medium through the jet holes.

Such a jet hole plate is formed by, for example, press working of a metal substrate (see, for example, JP-A-10-226070, and JP-A-2004-255696).

SUMMARY OF THE INVENTION

There is a common demand for a long-lasting jet hole plate. It is accordingly desirable to provide a jet hole plate, a liquid jet head, a liquid jet recording apparatus, and a method for manufacturing such a jet hole plate that can achieve a long life.

A jet hole plate according to an aspect of the present disclosure is a jet hole plate for use in a liquid jet head. The jet hole plate includes a metal substrate provided with a plurality of jet holes. The metal substrate has a principal surface provided with outlets of the jet holes. On the principal surface, a surface roughness (arithmetic mean roughness Ra) in outlet edge regions of the jet holes is smaller than that in surrounding regions around the outlet edge regions.

A liquid jet head according to an aspect of the present disclosure includes the jet hole plate.

A liquid jet recording apparatus according to an aspect of the present disclosure includes the liquid jet head, and a container for storing a liquid to be supplied to the liquid jet head.

A method for manufacturing a jet hole plate according to an aspect of the present disclosure includes:

(A) a punching step of pressing a first principal surface of a metal substrate with one or more punches to form a plurality of indentations in the first principal surface, and to form raised portions in a second principal surface of the metal substrate in positions opposite the indentations; and (B) a polishing step of removing the raised portions by mechanical polishing to penetrate the metal substrate at the indentations to thereby form a plurality of jet holes, so that a surface roughness (arithmetic mean roughness Ra) in a polished surfaces in outlet edge regions of the jet holes is smaller than that in surrounding regions around the polished surfaces.

The jet hole plate, the liquid jet head, the liquid jet recording apparatus, and the method for manufacturing a jet hole plate according to the aspects of the present disclosure can achieve a long life.

DETAILED DESCRIPTION OF THE PREFERRED EMBODIMENTS

An embodiment of the present disclosure is described below, with reference to the accompanying drawings. Descriptions are given in the following order.

1. Embodiment (Nozzle Plate, Inkjet Head, Printer, Method for Manufacturing Nozzle Plate)
2. Variations

1. Embodiment

Overall Configuration of Printer 1

Figure 1:
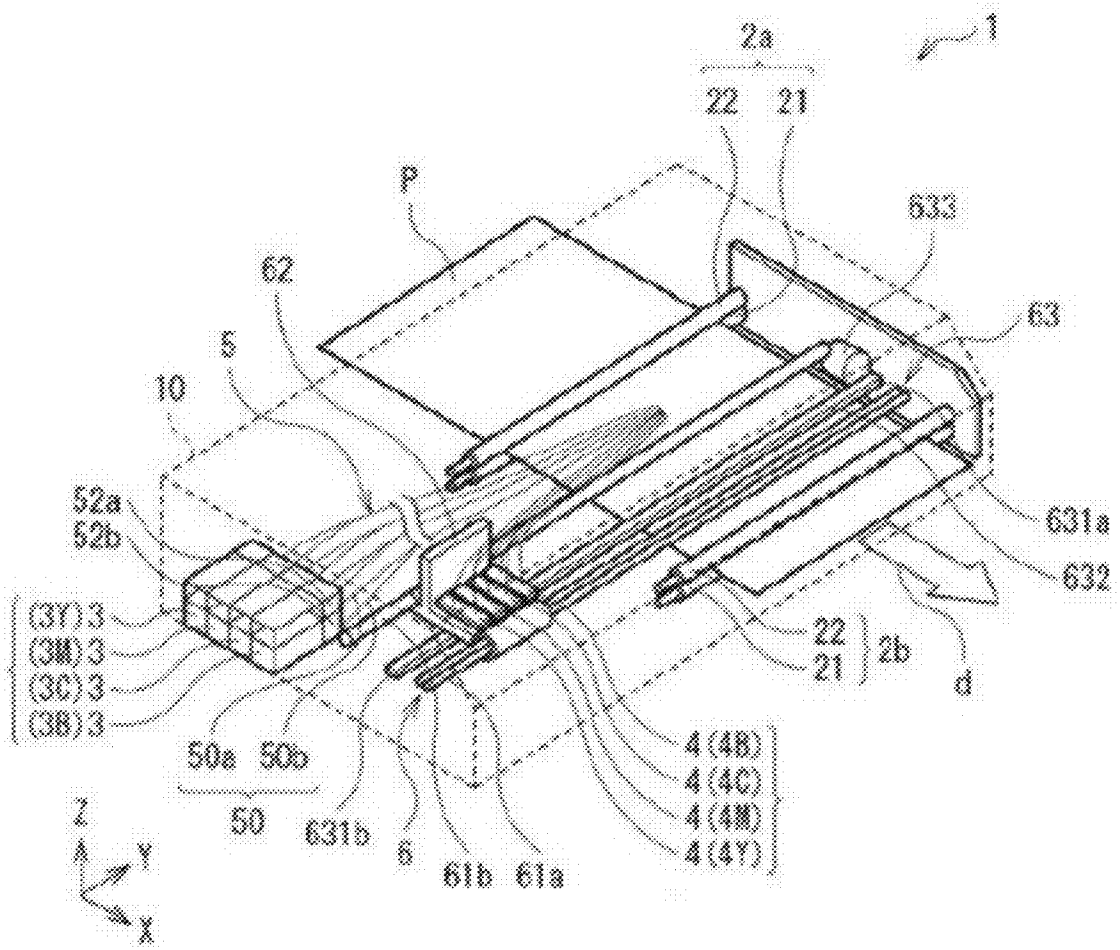
FIG. 1 is a perspective view schematically representing an example of a structure of a liquid jet recording apparatus according to an embodiment of the present disclosure.

FIG. 1 is a perspective view schematically representing an example of a structure of a printer 1 as a liquid jet recording apparatus according to an embodiment of the present disclosure. The printer 1 is an inkjet printer that records (prints) an image, texts, and the like on recording paper P (target recording medium), using an ink 9 (described later). The printer 1 is also an ink-circulating inkjet printer that circulates the ink 9 through a predetermined channel, as will be described later in detail.

As illustrated in FIG. 1, the printer 1 includes a pair of transport mechanisms 2*a* and 2*b*, ink tanks 3, inkjet heads 4, a circulation mechanism 5, and a scan mechanism 6. These members are housed in a housing 10 of a predetermined shape. The drawings referred to in the descriptions of the specification are appropriately scaled to show members in sizes that are easily recognizable. The printer 1 corresponds to a specific example of a liquid jet recording apparatus of the present disclosure. The inkjet heads 4 (inkjet heads 4Y, 4M, 4C, and 4B; described later) correspond to a specific example of a liquid jet head of the present disclosure.

Transport Mechanisms 2*a* and 2*b*

The transport mechanisms 2*a* and 2*b*, as shown in FIG. 1, are mechanisms that transport recording paper P along a transport direction d (X-axis direction). The transport mechanisms 2*a* and 2*b* each include a grid roller 21, a pinch roller 22, and a drive mechanism (not illustrated). The grid rollers 21 and the pinch rollers 22 extend along the Y-axis direction (width direction of recording paper P), respectively. The drive mechanisms rotate the grid rollers 21 about the roller axis (within a Z-X plane), and are configured by using, for example, a motor.

Ink Tanks 3

The ink tanks 3 store the ink 9 (liquid) to be supplied to the inkjet heads 4. That is, the ink tanks 3 are storages for ink 9. In this example, as shown in FIG. 1, the ink tanks 3 are four separate tanks storing inks 9 of four different colors: yellow (Y), magenta (M), cyan (C), and black (B). Specifically, the ink tanks 3 are an ink tank 3Y storing a yellow ink 9, an ink tank 3M storing a magenta ink 9, an ink tank 3C storing a cyan ink 9, and an ink tank 3B storing a black ink 9. The ink tanks 3Y, 3M, 3C, and 3B are disposed side by side in the housing 10 along X-axis direction. The ink tanks 3Y, 3M, 3C, and 3B have the same configuration, except for the color of the ink 9 stored therein, and accordingly will be collectively referred to as ink tank 3.

Inkjet Heads 4

The inkjet heads 4 record an image, texts, and the like by jetting (ejecting) the ink 9 against recording paper P in the form of droplets through a plurality of nozzle holes (nozzle holes H1 and H2; described later). In this example, as shown in FIG. 1, the inkjet heads 4 are four separate inkjet heads that jet the inks 9 of four different colors stored in the ink tanks 3Y, 3M, 3C, and 3B. That is, the inkjet heads 4 are the inkjet head 4Y for jetting the yellow ink 9, the inkjet head 4M for jetting the magenta ink 9, the inkjet head 4C for jetting the cyan ink 9, and the inkjet head 4B for jetting the black ink 9. The inkjet heads 4Y, 4M, 4C, and 4B are disposed side by side in the housing 10 along Y-axis direction.

Figure 3:
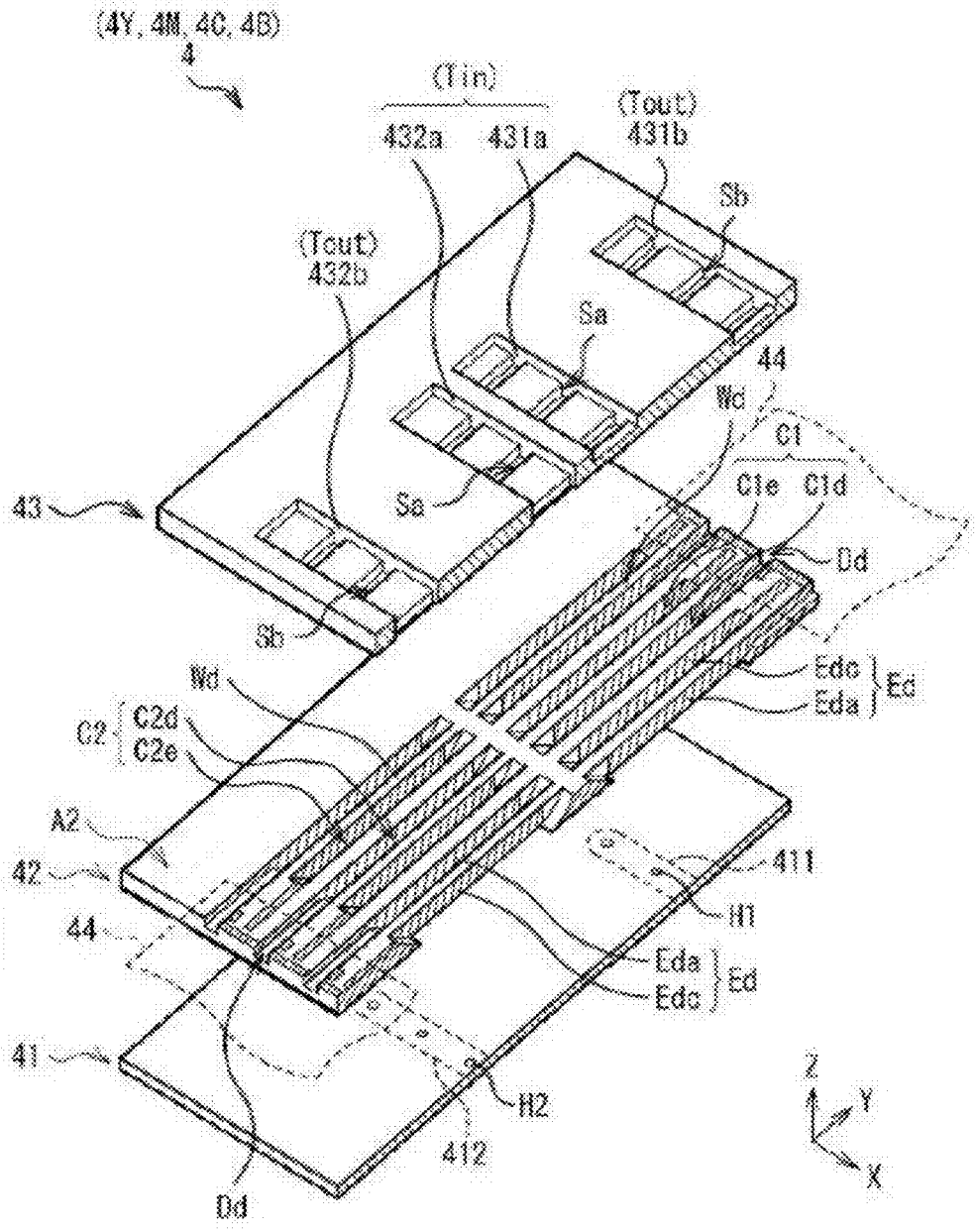
FIG. 3 is an exploded perspective view representing an exemplary structure of a liquid jet head of FIG. 2 in detail.
Figure 4:
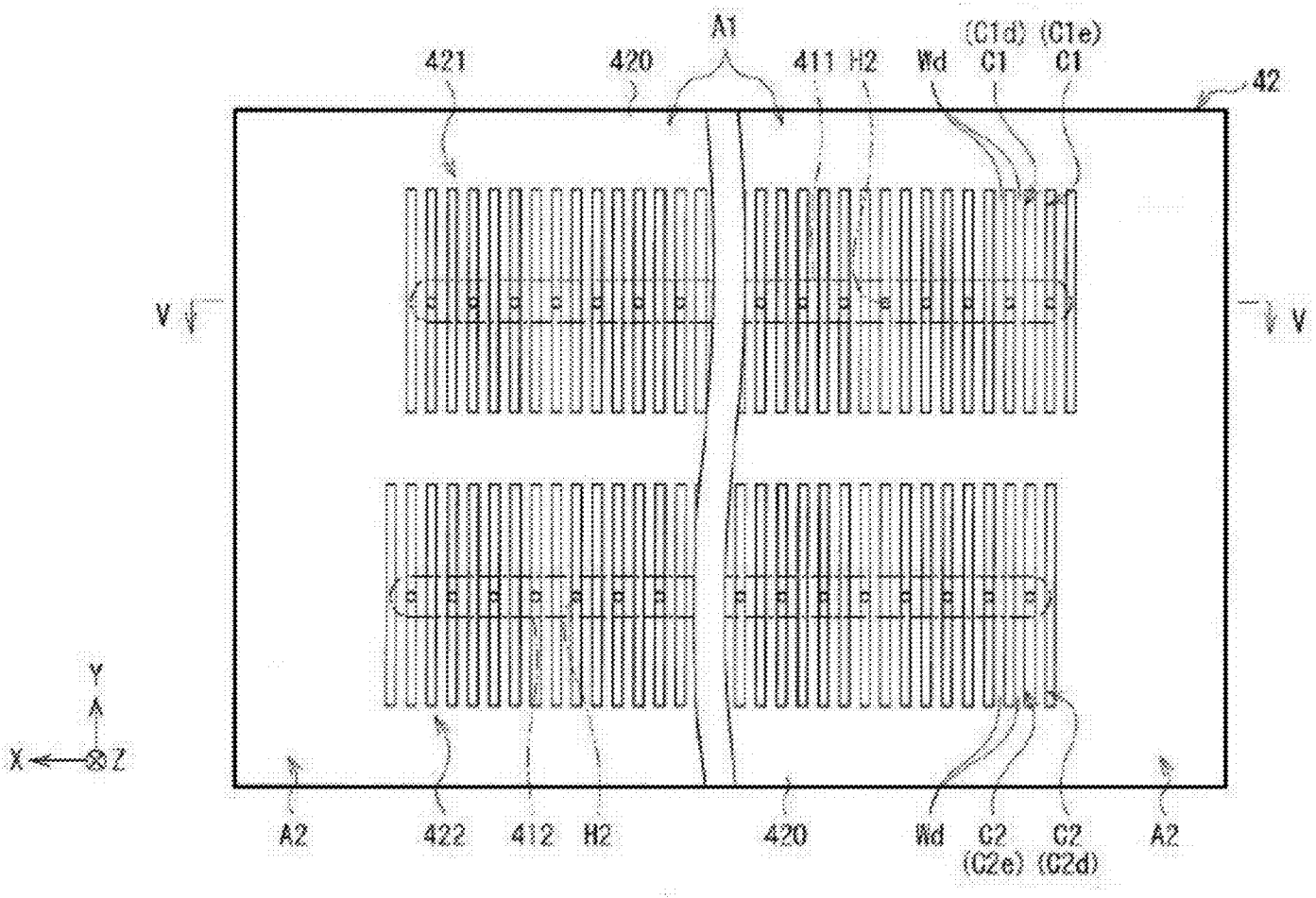
FIG. 4 schematically shows a bottom view of the exemplary structure of the liquid jet head, without a nozzle plate shown in FIG. 3.
Figure 5:
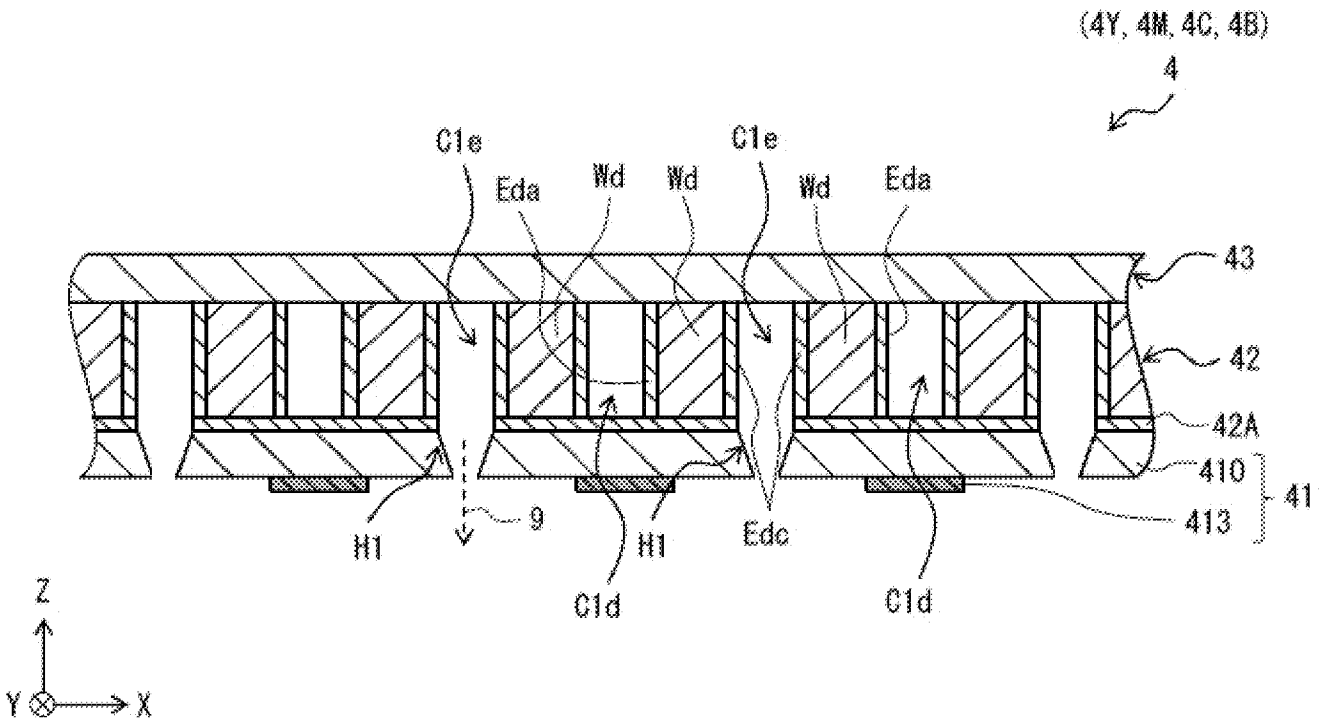
FIG. 5 is a schematic diagram showing a partial cross section of the exemplary structure at line V-V of FIG. 4.

The inkjet heads 4Y, 4M, 4C, and 4B have the same configuration, except for the color of the ink 9, and accordingly will be collectively referred to as inkjet head 4. The configuration of the inkjet heads 4 will be described later in greater detail (FIGS. 3 to 5).

Circulation Mechanism 5

Figure 2:
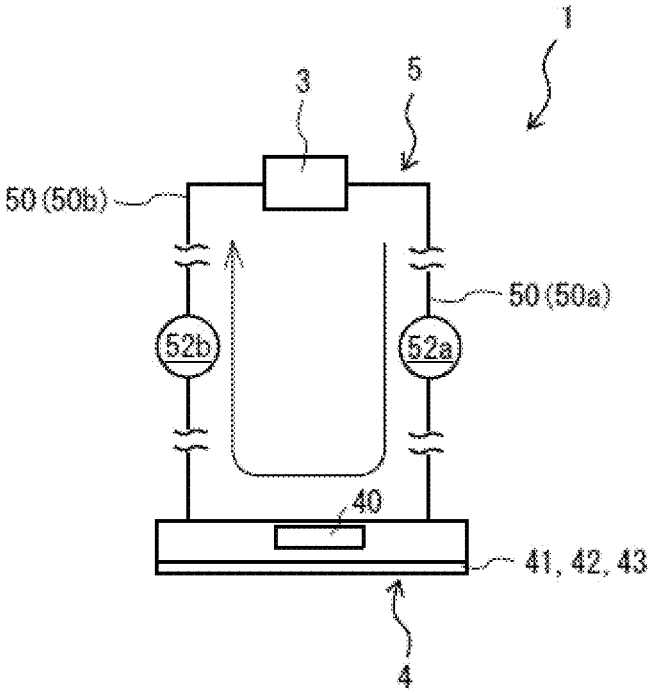
FIG. 2 schematically represents an exemplary detailed structure of a circulation mechanism and other members shown in FIG. 1.

The circulation mechanism 5 is a mechanism for circulating the ink 9 between the ink tank 3 and the inkjet head 4. FIG. 2 schematically represents an exemplary structure of the circulation mechanism 5, together with the ink tank 3 and the inkjet head 4. The solid arrow in FIG. 2 indicates the direction of circulation of the ink 9. As shown in FIG. 2, the circulation mechanism 5 includes a predetermined channel (circulation channel 50), and a pair of delivery pumps 52*a* and 52*b* for circulating the ink 9.

The circulation channel 50 is a channel through which the ink 9 circulates between the inkjet head 4 and outside of the inkjet head 4 (inside the ink tank 3). The circulation channel 50 has a channel 50*a* that connects the ink tank 3 to the inkjet head 4, and a channel 50*b* that connects the inkjet head 4 to the ink tank 3. In other words, the channel 50*a* represents a channel through which the ink 9 travels from the ink tank 3 to the inkjet head 4, and the channel 50*b* is a channel through which the ink 9 travels from the inkjet head 4 to the ink tank 3.

The delivery pump 52*a* is disposed between the ink tank 3 and the inkjet head 4 on the channel 50*a*. The delivery pump 52*a* is a pump for delivering the stored ink 9 in the ink tank 3 to the inkjet head 4 via the channel 50*a*. The delivery pump 52*b* is disposed between the inkjet head 4 and the ink tank 3 on the channel 50*b*. The delivery pump 52*b* is a pump for delivering the stored ink 9 in the inkjet head 4 to the ink tank 3 through the channel 50*b*.

Scan Mechanism 6

The scan mechanism 6 is a mechanism for scanning the inkjet head 4 along the width direction (Y-axis direction) of recording paper P. As illustrated in FIG. 1, the scan mechanism 6 includes a pair of guide rails 61*a* and 61*b* extending along the Y-axis direction, a carriage 62 movably supported on the guide rails 61*a* and 61*b*, and a drive mechanism 63 for moving the carriage 62 along the Y-axis direction. The drive mechanism 63 includes a pair of pulleys 631*a* and 631*b* disposed between the guide rails 61*a* and 61*b*, an endless belt 632 suspended between the pulleys 631*a* and 631*b*, and a drive motor 633 for driving and rotating the pulley 631*a*.

The pulleys 631*a* and 631*b* are disposed in regions corresponding to end portions of the guide rails 61*a* and 61*b*, respectively, along the Y-axis direction. The carriage 62 is joined to the endless belt 632. The inkjet heads 4Y, 4M, 4C, and 4B are disposed side by side on the carriage 62, along the Y-axis direction. The scan mechanism 6, together with the transport mechanisms 2*a* and 2*b*, constitutes a moving mechanism for moving the inkjet heads 4 and the recording paper P relative to each other.

Detailed Configuration of Inkjet Head 4

The following specifically describes an exemplary structure of the inkjet head 4, with reference to FIGS. 1 and 2, and FIGS. 3 to 5. FIG. 3 is an exploded perspective view showing an exemplary structure of the inkjet head 4 in detail. FIG. 4 schematically shows a bottom view (X-Y bottom view) of the exemplary structure of the inkjet head 4, without a nozzle plate 41 (described later) shown in FIG. 3. FIG. 5 is a schematic diagram showing a partial cross section (Z-X cross section) of the inkjet head 4 taken at line V-V of FIG. 4.

The inkjet head 4 of the present embodiment is what is generally called a side shoot-type inkjet head, and ejects the ink 9 from a central portion in the direction of extension (Y-axis direction) of a plurality of channels (channels C1 and C2; described later). The inkjet head 4 is also a circulatory inkjet head, allowing the ink 9 to circulate to and from the ink tank 3 with the use of the circulation mechanism 5 (circulation channel 50).

As illustrated in FIG. 3, the inkjet head 4 mainly includes the nozzle plate 41 (jet hole plate), an actuator plate 42, and a cover plate 43. The nozzle plate 41, the actuator plate 42, and the cover plate 43 are bonded to each other using, for example, an adhesive, and are laminated in Z-axis direction, in this order. In the following, the "top" of the inkjet head 4 is on the side of the cover plate 43, and the "bottom" of the inkjet head 4 is on the side the nozzle plate 41, relative to Z-axis direction. The nozzle plate 41 corresponds to a specific example of a jet hole plate of the present disclosure.

Nozzle Plate 41

The nozzle plate 41 is a plate used for the inkjet head 4. The nozzle plate 41 has a metal substrate 410 having a thickness of, for example, about 50 μm, and is bonded to the bottom surface of the actuator plate 42, as shown in FIG. 3. The metal substrate 410 used for the nozzle plate 41 is, for example, a stainless steel such as SUS316L and SUS304. As illustrated in FIGS. 3 and 4, the nozzle plate 41 (metal substrate 410) has two rows of nozzles (nozzle rows 411 and 412) extending along the X-axis direction. The nozzle rows 411 and 412 are disposed by being separated from each other in Y-axis direction by a predetermined distance. That is, the inkjet head 4 of the present embodiment is a two-row inkjet head. A method for manufacturing the nozzle plate 41 as a jet hole plate according to an embodiment of the present disclosure will be described later in detail.

The nozzle row 411 has the plurality of nozzle holes (jet holes) H1 that are disposed in a straight line by being separated from each other in X-axis direction by a predetermined distance. The nozzle holes H1 penetrate through the nozzle plate 41 in thickness direction (Z-axis direction), and are in communication with, for example, ejection channels C1*e* of the actuator plate 42 (described later), as shown in FIG. 5. Specifically, as illustrated in FIG. 4, the nozzle holes H1 are formed in a line, and correspond in position to a central portion of the ejection channels C1*e* relative to Y-axis direction. The pitch of the nozzle holes H1 along X-axis direction is the same as the pitch of the ejection channels C1*e* along X-axis direction. The ink 9 supplied through ejection channels C1*e* is ejected (jetted) out of the nozzle holes H1 of the nozzle row 411, as will be described later in detail. As with the case of the nozzle row 411, the nozzle row 412 has the plurality of nozzle holes (jet holes) H2 that are disposed in a straight line by being separated from each other in X-axis direction by a predetermined distance. The nozzle holes H2 penetrate through the nozzle plate 41 in thickness direction, and are in communication with, for example, ejection channels C2*e* of the actuator plate 42 (described later). Specifically, as illustrated in FIG. 4, the nozzle holes H2 are formed in a line, and correspond in position to a central portion of the ejection channels C2*e* relative to Y-axis direction. The pitch of the nozzle holes H2 along X-axis direction is the same as the pitch of the ejection channels C2*e* along X-axis direction. The ink 9 supplied through the ejection channels C2*e* is ejected out of the nozzle holes H2 of the nozzle row 412, as will be described later in detail.

Figure 6:
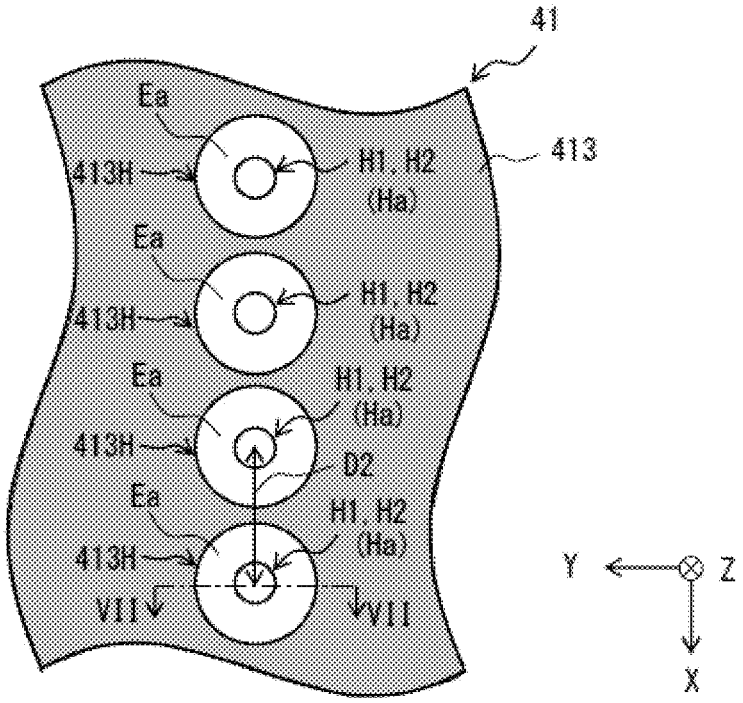
FIG. 6 is a partially enlarged schematic bottom view of the nozzle plate shown in FIG. 3.
Figure 7:
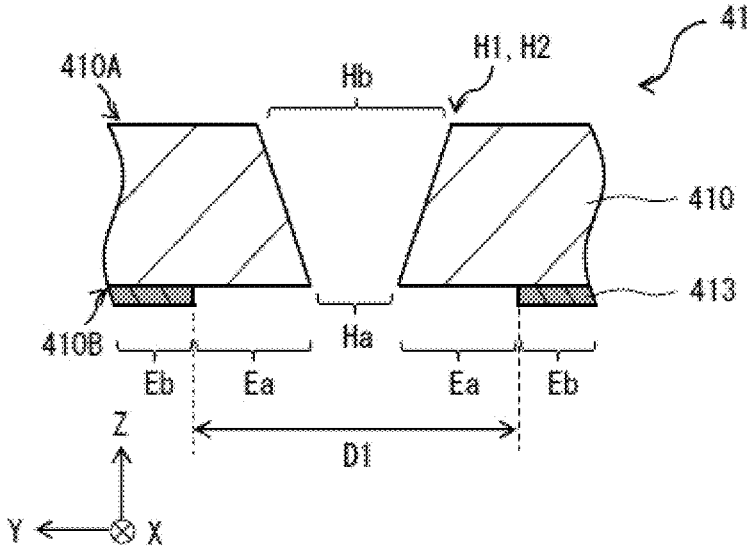
FIG. 7 is a cross sectional view schematically representing an exemplary structure at line VII-VII of FIG. 6.
Figure 8:
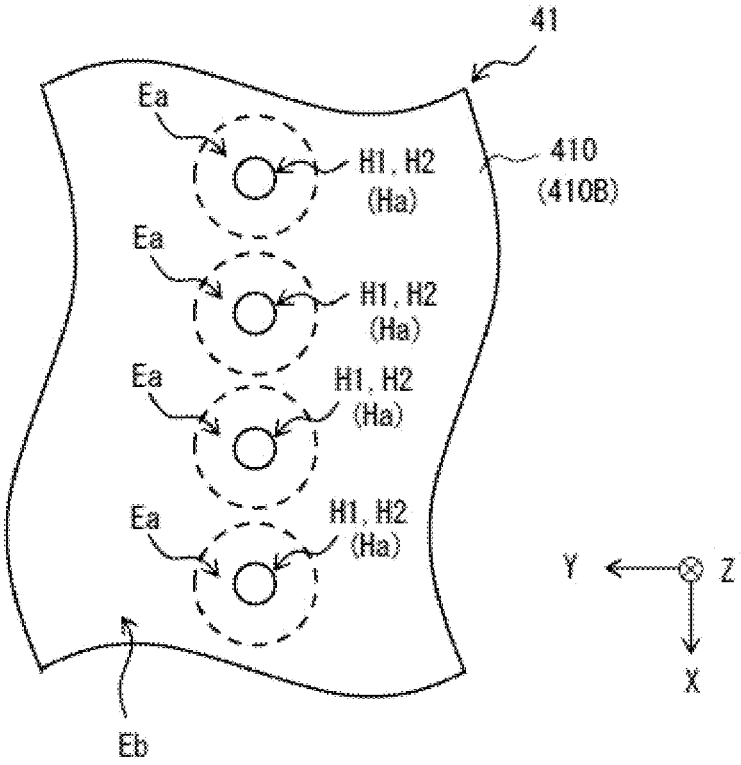
FIG. 8 is a partially enlarged schematic bottom view of the nozzle plate without a water-repellent film shown in FIG. 6.

FIG. 6 is a partially enlarged view of an exemplary structure (X-Y plane exemplary structure) of the bottom surface of the nozzle plate 41. FIG. 7 is a cross sectional view schematically representing an exemplary structure (Y-Z cross section exemplary structure), taken at line VII-VII of FIG. 6. FIG. 8 is a partially enlarged view of the exemplary structure (X-Y plane exemplary structure) of the bottom surface of the nozzle plate 41, without a liquid repellent film 413 (described later) shown in FIG. 6.

The nozzle plate 41 has the metal substrate 410 having the plurality of nozzle holes H1, and the plurality of nozzle holes H2. The metal substrate 410 has an outlet-side principal surface 410B having outlets Ha for the nozzle holes H1 and H2, and an inlet-side principal surface 410A having inlets Hb, larger than the outlets H1, provided for the nozzle holes H1 and H2. The nozzle holes H1 and H2 are tapered through holes of gradually decreasing diameter toward the bottom. The outlet-side principal surface 410B has a surface roughness (arithmetic mean roughness Ra) that is smaller in an outlet edge region Ea of the nozzle holes H1 and H2 than in a surrounding region Eb around the outlet edge region Ea (formula (1)). The surface roughness (arithmetic mean roughness Ra) is based on ISO 4287-1997 standards, and is measured with, for example, a non-contact measurement device such as a laser microscope and a white light interferometer, and a contact measurement device such as a stylus surface roughness meter.

$$Ra1 < Ra2 \qquad \text{Formula (1)}$$

Ra1: Surface roughness (arithmetic mean roughness Ra) of outlet edge region Ea Ra2: Surface roughness (arithmetic mean roughness Ra) of surrounding region Eb The outlet edge region Ea includes at least a region of the metal substrate 410 opposite the inlet Hb in a thickness direction of the metal substrate 410. The surrounding region Eb is the region of the outlet-side principal surface 410B excluding the outlet edge region Ea. The outlet edge region Ea has, for example, a circular ring shape. The shape of the outlet edge region Ea is not limited to a circular ring shape. The outlet edge region Ea may have, for example, an ellipsoidal ring shape or a square ring shape. In the case of an outlet edge region Ea having a circular ring shape, the outer diameter D1 of the outlet edge region Ea is smaller than the pitch D2 of the nozzle holes H1 and H2. That is, the outlet edge regions Ea are separated from each other on the outlet-side principal surface 410B.

The outlet edge region Ea is a polished surface formed by mechanical polishing. The outlet edge region Ea is, for example, a region polished by tape polishing. When the metal substrate 410 is configured from a stainless steel such as SUS316L, the outlet edge region Ea has a surface roughness Ra1 of, for example, 0.001 μm to 0.1 μm. The surrounding region Eb is an unpolished region, or a more coarsely polished region compared to the outlet edge region Ea. When the metal substrate 410 is configured from a stainless steel such as SUS316L, the surrounding region Eb has a surface roughness Ra2 of, for example, 0.2 μm to 1.0 μm.

The nozzle plate 41 also includes a liquid repellent film 413 that directly contacts the outlet-side principal surface 410B. The liquid repellent film 413 is formed on the outlet-side principal surface 410B except in the outlet edge regions Ea, and covers the surrounding regions Eb either in part or as a whole. For example, the liquid repellent film 413 is formed in contact with the surrounding regions Eb, either in part or as a whole. The liquid repellent film 413 has an opening 413H in a position opposite the outlet edge region Ea and the outlet Ha. The opening 413H surrounds each outlet edge region Ea on the outlet-side principal surface 410B. The liquid repellent film 413 is useful for effectively removing ink 9 from the outlet-side principal surface 410B when wiping the outlet-side principal surface 410B for cleaning. The liquid repellent film 413 may be a fluororesin, for example, such as PTFE (polytetrafluoroethylene), PFEP (a tetrafluoroethylene-hexafluoropropylene copolymer), PFA (a tetrafluoroethylene-perfluoroalkylvinyl ether copolymer), and FEP (an ethylene tetrafluoride-propylene hexafluoride copolymer). Aside from fluororesins, for example, a fluorinated silane coupling agent or a fluorine-containing acrylic resin may be used for the liquid repellent film 413.

Actuator Plate 42

The actuator plate 42 is a plate configured from, for example, a piezoelectric material such as PZT (lead zirconate titanate). The actuator plate 42 is what is generally called a chevron-type actuator, which is formed by laminating two piezoelectric substrates of different polarization directions in Z direction. The actuator plate 42 may be a so-called cantilever-type actuator formed of a single piezoelectric substrate of a unidirectional polarization direction along the thickness direction (Z-axis direction). As shown in FIGS. 3 and 4, the actuator plate 42 has two rows of channels (channel rows 421 and 422) extending along X-axis direction. The channel rows 421 and 422 are disposed by being separated from each other in Y-axis direction by a predetermined distance.

The actuator plate 42 has an ejection region (jet region) A1 for ink 9, provided at the central portion (the region where the channel rows 421 and 422 are formed) relative to X-axis direction, as shown in FIG. 4. The actuator plate 42 also has a non-ejection region (non-jet region) A2 for ink 9, provided at the both end portions (the region where the channel rows 421 and 422 are not formed) relative to X-axis direction. The non-ejection region A2 is on the outer side of the ejection region A1 relative to X-axis direction. The regions at the both ends of the actuator plate 42 in Y-axis direction constitute tail portions 420.

As illustrated in FIGS. 3 and 4, the channel rows 421 have a plurality of channels C1 extending in Y-axis direction. The channels C1 are disposed side by side, parallel to each other, by being separated from each other in X-axis direction by a predetermined distance. The channels C1 are defined by drive walls Wd of the piezoelectric body (actuator plate 42), and form grooves of a depressed shape as viewed in a cross section (see FIG. 3).

As with the case of the channel rows 421, the channel rows 422 have a plurality of channels C2 extending in Y-axis direction. The channels C2 are disposed side by side, parallel to each other, by being separated from each other in X-axis direction by a predetermined distance. The channels C2 are defined by the drive walls Wd, and form grooves of a depressed shape as viewed in a cross section.

As illustrated in FIGS. 3 and 4, the channels C1 include the ejection channels C1*e* for ejecting ink 9, and dummy channels C1*d* that do not eject ink 9. In the channel rows 421, the ejection channels C1*e* and the dummy channels C1*d* are alternately disposed in X-axis direction. The ejection channels C1*e* are in communication with the nozzle holes H1 of the nozzle plate 41, whereas the dummy channels C1*d* are covered from below by the top surface of the nozzle plate 41, and are not in communication with the nozzle holes H1.

As with the case of the channels C1, the channels C2 include the ejection channels C2*e* for ejecting ink 9, and dummy channels C2*d* that do not eject ink 9. In the channel rows 422, the ejection channels C2*e* and the dummy channels C2*d* are alternately disposed in X-axis direction. The ejection channels C2*e* are in communication with the nozzle holes H2 of the nozzle plate 41, whereas the dummy channels C2*d* are covered from below by the top surface of the nozzle plate 41, and are not in communication with the nozzle holes H2.

As illustrated in FIG. 4, the ejection channels C1*e* and the dummy channels C1*d* of the channels C1 are alternately disposed with respect to the ejection channels C2*e* and the dummy channels C2*d* of the channels C2. That is, in the inkjet head 4 of the present embodiment, the ejection channels C1*e* of the channels C1, and the ejection channels C2*e* of the channels C2 are disposed in a staggered fashion. As illustrated in FIG. 3, shallow grooves Dd that are in communication with the outer end portions of the dummy channels C1*d* and C2*d* along Y-axis direction are formed in portions of the actuator plate 42 corresponding to the dummy channels C1*d* and C2*d*.

As illustrated in FIGS. 3 and 5, drive electrodes Ed extending in Y-axis direction are provided on the opposing inner surfaces of the drive walls Wd. The drive electrodes Ed include common electrodes Edc provided on inner surfaces facing the ejection channels C1*e* and C2*e*, and active electrodes Eda provided on inner surfaces facing the dummy channels C1*d* and C2*d*. As illustrated in FIG. 5, the drive electrodes Ed (common electrodes Edc and active electrodes Eda) on the inner surfaces of the drive walls Wd have the same depth as the drive walls Wd (the same depth in Z-axis direction). In the actuator plate 42, an insulating film 42A for preventing electrical shorting between the drive electrodes Ed and the nozzle plate 41 is formed on the surface facing the nozzle plate 41. When the actuator plate 42 is the above-described cantilever-type actuator, the drive electrodes Ed (common electrodes Edc and the active electrodes Eda) are formed about a halfway through the depth (Z-axis direction) of the drive walls Wd on the inner surfaces.

A pair of opposing common electrodes Edc in the same ejection channel C1*e* (or the same ejection channel C2*e*) are electrically connected to each other via a common terminal (not illustrated). A pair of opposing active electrodes Eda in the same dummy channel C1*d* (or the same dummy channel C2*d*) are electrically isolated from each other. On the other hand, a pair of active electrodes Eda facing each other via the same ejection channel C1*e* (or the same ejection channel C2*e*) are electrically connected to each other via an active terminal (not illustrated).

As illustrated in FIG. 3, flexible printed boards 44 that electrically connect the drive electrodes Ed to a control section (a control section 40 for inkjet heads 4; described later) are mounted on the tail portions 420. The wiring patterns (not illustrated) formed on the flexible printed boards 44 are electrically connected to the common terminal and the active terminal. This enables the control section 40 to apply a drive voltage to each drive electrode Ed via the flexible printed boards 44.

Cover Plate 43

As illustrated in FIG. 3, the cover plate 43 is disposed so as to close the channels C1 and C2 (the channel rows 421 and 422) of the actuator plate 42. Specifically, the cover plate 43 has a plate-shaped structure bonded to the top surface of the actuator plate 42.

As shown in FIG. 3, the cover plate 43 has a pair of inlet-side common ink chambers 431*a* and 432*a*, and a pair of outlet-side common ink chambers 431*b* and 432*b*. Specifically, the inlet-side common ink chamber 431*a* and the outlet-side common ink chamber 431*b* are formed in regions corresponding to the channel rows 421 (the plurality of channels C1) of the actuator plate 42. The inlet-side common ink chamber 432*a* and the outlet-side common ink chamber 432*b* are formed in regions corresponding to the channel rows 422 (the plurality of channels C2) of the actuator plate 42.

The inlet-side common ink chamber 431*a* has a depressed groove shape, and is formed in the vicinity of the inner end portion of the channels C1 relative to Y-axis direction. A supply slit Sa is formed in a region of the inlet-side common ink chamber 431*a* corresponding to the ejection channel C1*e*, through the thickness (Z-axis direction) of the cover plate 43. Similarly, the inlet-side common ink chamber 432*a* has a depressed groove shape, and is formed in the vicinity of the inner end portion of the channels C2 relative to Y-axis direction. The supply slit Sa is also formed in a region of the inlet-side common ink chamber 432*a* corresponding to the ejection channel C2*e*. The inlet-side common ink chambers 431*a* and 432*a* constitute an inlet portion Tin of the inkjet head 4.

As illustrated in FIG. 3, the outlet-side common ink chamber 431*b* has a depressed groove shape, and is formed in the vicinity of the outer end portion of the channels C1 relative to Y-axis direction. A discharge slit Sb is formed in a region of the outlet-side common ink chamber 431*b* corresponding to the ejection channel C1*e*, through the thickness of the cover plate 43. Similarly, the outlet-side common ink chamber 432*b* has a depressed groove shape, and is formed in the vicinity of the outer end portion of the channels C2 relative to Y-axis direction. The discharge slit Sb is also formed in a region of the outlet-side common ink chamber 432*b* corresponding to the ejection channel C2*e*. The outlet-side common ink chambers 431*b* and 432*b* constitute an outlet portion Tout of the inkjet head 4.

That is, the inlet-side common ink chamber 431*a* and the outlet-side common ink chamber 431*b* are in communication with the ejection channels C1*e* via the supply slits Sa and the discharge slits Sb, and are not in communication with the dummy channels C1*d*. In other words, the dummy channels C1*d* are closed by the bottom portions of the inlet-side common ink chamber 431*a* and the outlet-side common ink chamber 431*b*.

Similarly, the inlet-side common ink chamber 432*a* and the outlet-side common ink chamber 432*b* are in communication with the ejection channels C2*e* via the supply slits Sa and the discharge slits Sb, and are not in communication with the dummy channels C2*d*. In other words, the dummy channels C2*d* are closed by the bottom portions of the inlet-side common ink chamber 432*a* and the outlet-side common ink chamber 432*b*.

Control Section 40

As illustrated in FIG. 2, a control section 40 for controlling various operations of the printer 1 is provided in the inkjet head 4 of the present embodiment. The control section 40 controls, for example, the operation of various components, such as the delivery pumps 52*a* and 52*b*, in addition to controlling the recording operation of the printer 1 recording an image, texts, and the like (the operation of the inkjet head 4 ejecting ink 9). The control section 40 is configured from, for example, a microcomputer that includes an arithmetic processing unit, and a memory section including various types of memory.

Basic Operation of Printer 1

The printer 1 records (prints) an image, texts, and the like on recording paper P in the manner described below. As an initial state, it is assumed here that the four ink tanks 3 (3Y, 3M, 3C, and 3B) shown in FIG. 1 contain inks of corresponding (four) colors in sufficient amounts. Initially, the inkjet heads 4 have been charged with the inks 9 from the ink tanks 3 through the circulation mechanism 5.

In such an initial state, activating the printer 1 rotates the grid rollers 21 of the transport mechanisms 2*a* and 2*b*, and transports recording paper P between the grid rollers 21 and the pinch rollers 22 in a transport direction d (X-axis direction). Simultaneously with this transport operation, the drive motor 633 of the drive mechanism 63 rotates the pulleys 631*a* and 631*b* to move the endless belt 632. In response, the carriage 62 moves back and forth in the width direction (Y-axis direction) of the recording paper P by being guided by the guide rails 61*a* and 61*b*. Here, the inkjet heads 4 (4Y, 4M, 4C, and 4B) appropriately eject inks 9 of four colors onto the recording paper P to record images, texts, and the like on the recording paper P.

Detailed Operation of Inkjet Head 4

The operation of the inkjet head 4 (inkjet operation for ink 9) is described below in detail, with reference to FIGS. 1 to 5. The inkjet head 4 of the present embodiment (a side-shoot, circulatory inkjet head) ejects ink 9 in shear mode, as follows.

In response to the carriage 62 (see FIG. 1) having started its reciprocal movement, the control section 40 applies a drive voltage to the drive electrodes Ed (common electrodes Edc and active electrodes Eda) of the inkjet head 4 via the flexible printed boards 44. Specifically, the control section 40 applies a drive voltage to the drive electrodes Ed disposed on the pair of drive walls Wd defining the ejection channels C1*e* and C2*e*. This causes the pair of drive walls Wd to deform outwardly toward the dummy channels C1*d* and C2*d* adjacent the ejection channels C1*e* and C2*e* (see FIG. 5).

That is, the ejection channels C1*e* and C2*e* increase their volume as a result of the flexural deformation of the pair of drive walls Wd. The ink 9 stored in the inlet-side common ink chambers 431*a* and 432*a* is guided into the ejection channels C1*e* and C2*e* as the volume of ejection channels C1*e* and C2*e* increases (see FIG. 3).

The ink 9 guided into the ejection channels C1*e* and C2*e* creates a pressure wave, and propagates into the ejection channels C1*e* and C2*e*. The drive voltage applied to the drive electrodes Ed becomes 0 (zero) volt at the timing when the pressure wave reaches the nozzle holes H1 and H2 of the nozzle plate 41. In response, the drive walls Wd return to their original shape from the flexurally deformed state, bringing the ejection channels C1*e* and C2*e* back to their original volume (see FIG. 5).

The pressure inside the ejection channels C1*e* and C2*e* increases, and pressurizes the ink 9 inside the ejection channels C1*e* and C2*e* as the volume of the ejection channels C1*e* and C2*e* is restored. This causes the ink 9 to be ejected to outside (toward the recording paper P) in the form of droplets through the nozzle holes H1 and H2 (see FIG. 5). The inkjet head 4 ejects (discharges) the ink 9 in this manner, and records images, texts, and the like on the recording paper P. The ink 9 can be ejected in a straight line (good straight-line stability) at high speed because of the tapered shape of the nozzle holes H1 and H2 of the present embodiment of gradually decreasing diameter toward the bottom (see FIG. 5). This enables high-quality recording.

Method for Manufacturing Nozzle Plate 41

Figure 9:
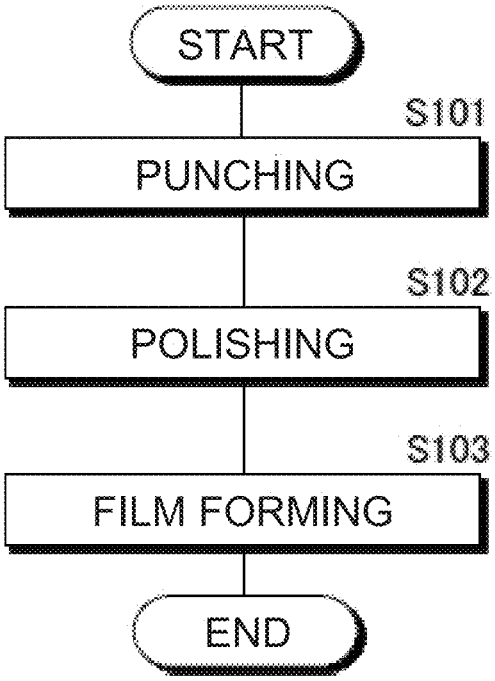
FIG. 9 is a diagram representing an exemplary procedure of manufacturing the nozzle plate of an embodiment.

A method for manufacturing the nozzle plate 41 is described below. FIG. 9 is a diagram representing an exemplary procedure of manufacturing the nozzle plate 41. FIGS. 10A to 10D are cross sectional views representing an example of manufacturing steps of the nozzle plate 41.

Figure 10A:
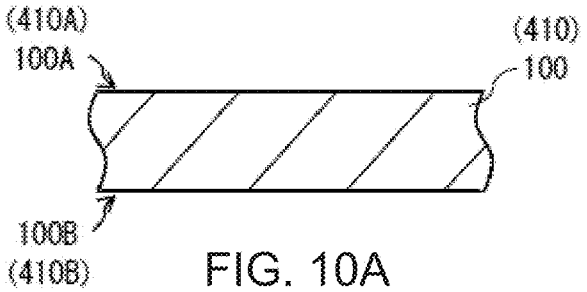
FIG. 10A is a cross sectional view representing an example of a manufacturing step of the nozzle plate according to an embodiment.

First, a metal substrate 100 is prepared (FIG. 10A). The metal substrate 100 is formed of a stainless steel such as SUS316L and SUS304. The metal substrate 100 has a first principal surface 100A on one side, and a second principal surface 100B on the other side. The metal substrate 100 becomes the metal substrate 410 after working. The first principal surface 100A of the metal substrate 100 is the surface that becomes the inlet-side principal surface 410A of the metal substrate 410, and the second principal surface 100B of the metal substrate 100 is the surface that becomes the outlet-side principal surface 410B of the metal substrate 410.

Figure 10B:
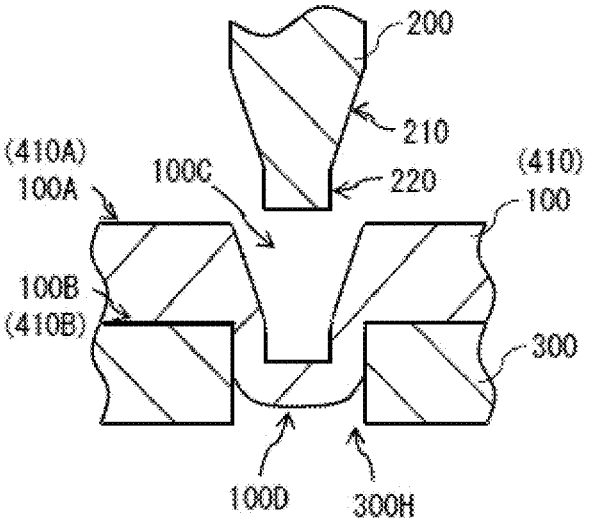
FIG. 10B is a cross sectional view representing an example of a manufacturing step after FIG. 10A.

The next step is punching (step S101). First, the metal substrate 100 is fixed on a die 300 with the first principal surface 100A facing up. The die 300 has a plurality of through holes 300H having the same pitch as the nozzle holes H1 and H2 of the nozzle plate 41 in X-axis direction. The through hole 300H has a larger diameter than a cylindrical portion 220 of a punch 200 (described later). The first principal surface 100A of the metal substrate 100 is then pressed with one or more punches 200. Specifically, the first principal surface 100A of the metal substrate 100 is pressed with one or more punches 200 in portions facing the through holes 300H. This forms a plurality of indentations 100C in the first principal surface 100A, and, at the same time, raised portions 100D in portions of the second principal surface 100B facing the indentations 100C (FIG. 10B). Here, the plurality of indentations 100C, and the plurality of raised portions 100D are formed in a line in the metal substrate 100.

The punch 200 has a frustoconical tapered portion 210, and the cylindrical portion 220 formed in contact with an end of the tapered portion 210. The indentation 100C formed under the pressure of the punch 200 therefore has an inverted shape from the shape of the punch 200. Specifically, the indentation 100C has a frustoconical tapered hole portion, and a cylindrical hole portion continuous from the tapered hole portion. The indentation 100C is deeper than the thickness of the metal substrate 100 (the distance between the first principal surface 100A and the second principal surface 100B).

Figure 10C:
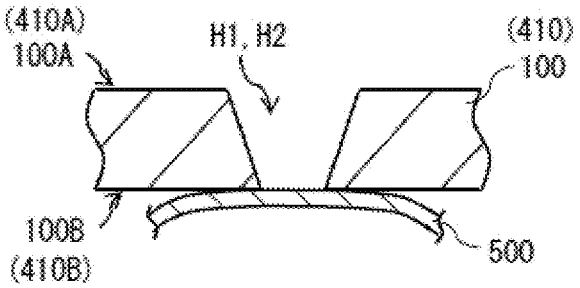
FIG. 10C is a cross sectional view representing an example of a manufacturing step after FIG. 10B.

The next step is polishing (step S102). Specifically, the raised portions 100D are removed by mechanical polishing to open the indentations 100C, and form the nozzle holes H1 and H2 (FIG. 10C). Here, the surface is mechanically polished in such a manner that the polished surface in the outlet edge regions Ea of the nozzle holes H1 and H2 has the surface roughness Ra1 (arithmetic mean roughness Ra) that is smaller than a surface roughness Ra2 (arithmetic mean roughness Ra) of the surrounding regions Eb around the outlet edge regions Ea (polished surface). The mechanical polishing may be performed with, for example, a tape 500 (tape polishing). The tape 500 is, for example, a long polyester film of about 75 μm thick with a plurality of abrasive grains fixed over substantially the whole surface on one side of the film.

There are cases where the pressure of the punch 200 causes a wave near the inlet Hb of the nozzle holes H1 and H2 (end portions of the nozzle holes H1 and H2 on the actuator plate 42 side). In this case, the first principal surface 100A may be flattened by mechanical polishing when removing the raised portions 100D. This produces the substantially flat first principal surface 100A.

Figure 10D:
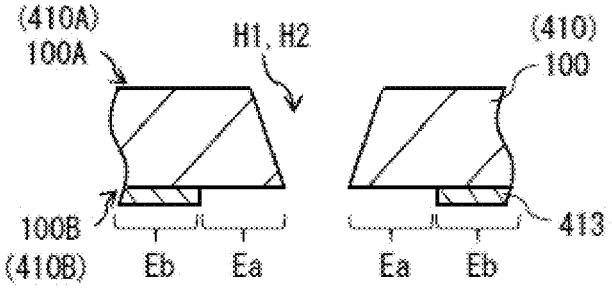
FIG. 10D is a cross sectional view representing an example of a manufacturing step after FIG. 10C.

This is followed by formation of the liquid repellent film 413 (step S103). Specifically, the liquid repellent film 413 is formed that directly contacts the second principal surface 100B (FIG. 10D). For example, a mask having openings in positions corresponding to the surrounding regions Eb (not illustrated) is disposed on the second principal surface 100B, and a material containing a material of the liquid repellent film 413 (for example, a fluorine-based silane coupling agent) is fixed over the whole surface, including the mask, by, for example, dipping, spraying, brush coating, fabric coating, spin coating, roller coating, coating with a knife coater, or coating with a film coater. The film formed by using these methods is then dried to form the liquid repellent film 413. This completes the nozzle plate 41.

Advantages

The following describes advantages of the nozzle plate 41 as a jet hole plate according to an embodiment of the present disclosure.

Printers equipped with inkjet heads are used in a wide range of applications. An inkjet head includes a plurality of laminated plates including a nozzle plate having formed therein large numbers of nozzle holes, and is configured to eject liquid, specifically, ink, against a target recording medium through the nozzle holes. A long life is desired in such a nozzle plate. However, traditional nozzle plates are often cleaned as a part of regular maintenance by wiping the surface where the outlets of the nozzle holes are formed. Here, the friction of wiping may cause detachment of the liquid repellent film provided on the ejection surface, and, in this case, the nozzle plate may become dysfunctional, with the result that the life of the nozzle plate is cut short.

In the nozzle plate 41 according to the present embodiment, the outlet edge regions Ea of the nozzle holes H1 and H2 on the outlet-side principal surface 410B of the metal substrate 410 constituting the nozzle plate 41 has a surface roughness Ra1 (arithmetic mean roughness Ra) that is smaller than the surface roughness Ra2 (arithmetic mean roughness Ra) of the surrounding regions Eb around the outlet edge regions Ea. Because the outlet edge region Ea is smoother than the surrounding region Eb, the surface roughness at the edges of the outlets becomes less of a factor of undesirable effects on ejection of the ink, such as attenuation and deflection. This ensures ejection quality. Additionally, because of the rough surrounding region Eb, the liquid repellent film 413 has good adhesion for the outlet-side principal surface 410B. Accordingly, the liquid repellent film 413 provided on the outlet-side principal surface 410B does not easily detach itself under the friction of wiping. This makes it possible to provide a longer life for the nozzle plate 41 while maintaining the ejection quality.

In the nozzle plate 41 according to the present embodiment, the outlet edge region Ea is a polished surface formed by mechanical polishing. Because the outlet edge region Ea is a polished surface smoother than the surrounding region Eb, the ejection quality is maintained. Mechanical polishing also enables easier selective polishing of only the outlet edge region Ea compared to chemical polishing, and provides roughness to the surrounding region Eb. The liquid repellent film 413 therefore has good adhesion for the outlet-side principal surface 410B. Accordingly, the liquid repellent film 413 provided on the outlet-side principal surface 410B does not easily detach itself under the friction of wiping. This makes it possible to provide a longer life for the nozzle plate 41 while maintaining the ejection quality.

The nozzle plate 41 according to the present embodiment includes the liquid repellent film 413 that directly contacts the outlet-side principal surface 410B. That is, in the present embodiment, the liquid repellent film 413 is in direct contact with the outlet-side principal surface 410B that includes the rough surrounding region Eb, and the liquid repellent film 413 has good adhesion for the outlet-side principal surface 410B. Accordingly, the liquid repellent film 413 provided on the outlet-side principal surface 410B does not easily detach itself under the friction of wiping. With the second principal surface 100B (outlet-side principal surface 410B) protected by the liquid repellent film 413, the nozzle plate 41 can have a longer life.

In the method for manufacturing of the nozzle plate 41 according to the present embodiment, the mechanical polishing that forms the nozzle holes H1 and H2 is performed in such a manner that the polished surface formed in the outlet edge regions Ea of the nozzle holes H1 and H2 by mechanical polishing has the surface roughness Ra1 (arithmetic mean roughness Ra) that is smaller than the surface roughness Ra2 (arithmetic mean roughness Ra) of the surrounding regions Eb around the outlet edge regions Ea (polished surface). Because the outlet edge region Ea is smoother than the surrounding region Eb, the ejection quality is maintained. Additionally, the surrounding region Eb has roughness, and the liquid repellent film 413 has good adhesion for the outlet-side principal surface 410B. Accordingly, the liquid repellent film 413 provided on the outlet-side principal surface 410B does not easily detach itself under the friction of wiping. This makes it possible to provide a longer life for the nozzle plate 41 while maintaining the ejection quality.

The method for manufacturing the nozzle plate 41 according to the present embodiment forms the liquid repellent film 413 that directly contacts the second principal surface 100B. That is, in the present embodiment, the liquid repellent film 413 is in direct contact with the second principal surface 100B (outlet-side principal surface 410B) that includes the rough surrounding region Eb, and the liquid repellent film 413 has good adhesion for the second principal surface 100B (outlet-side principal surface 410B). Accordingly, the liquid repellent film 413 provided on the second principal surface 100B (outlet-side principal surface 410B) does not easily detach itself under the friction of wiping. With the second principal surface 100B (outlet-side principal surface 410B) protected by the liquid repellent film 413, the nozzle plate 41 can have a longer life.

2. Variations

While the present disclosure has been described through an embodiment, the present disclosure is not limited to the embodiment above, and may be modified in a variety of ways.

Variation A

Figure 11:
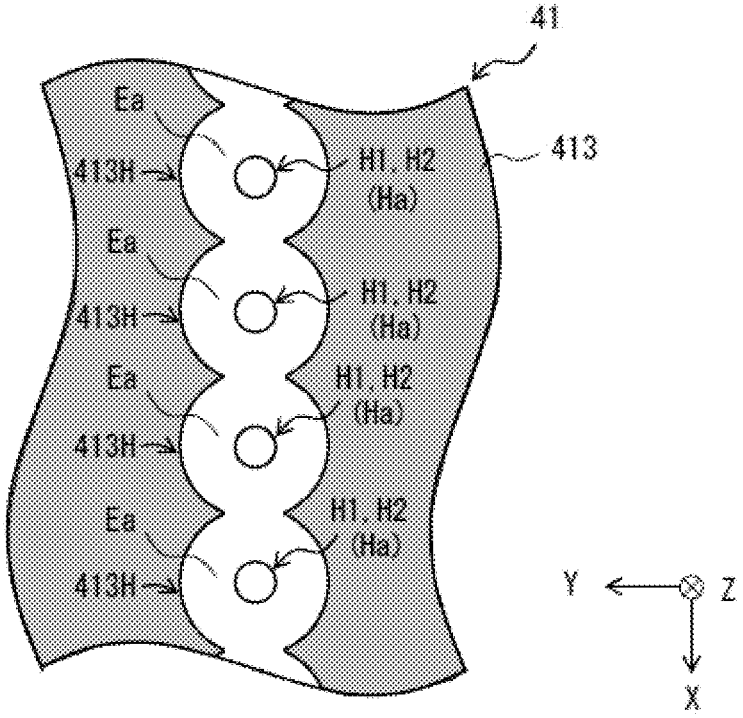
FIG. 11 is a partially magnified schematic bottom view of a nozzle plate according to a variation.
Figure 12:
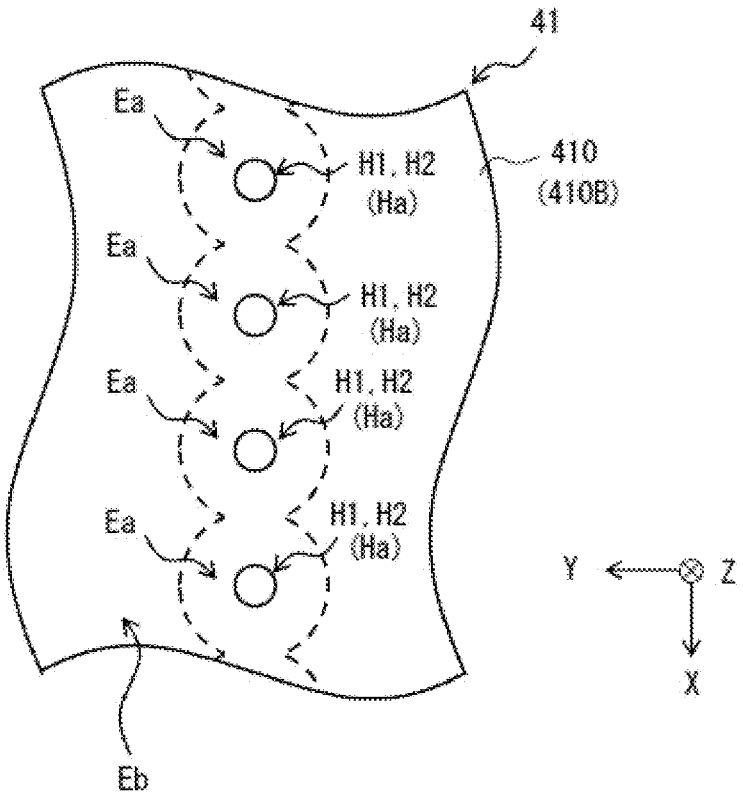
FIG. 12 is a partially magnified schematic bottom view of the nozzle plate without a water-repellent film shown in FIG. 11.

For example, in the foregoing embodiment, the outlet edge regions Ea are provided by being separated from each other on the outlet-side principal surface 410B. However, for example, as illustrated in FIGS. 11 and 12, the outlet edge regions Ea formed in a line may be in contact with each other between the adjacent outlet edge regions Ea. FIG. 11 is a partially magnified view representing an exemplary structure (X-Y plane exemplary structure) of the bottom surface of the nozzle plate 41 according to variation A. FIG. 12 is a partially magnified view representing an exemplary structure (X-Y plane exemplary structure) of the bottom surface of the nozzle plate 41, without the liquid repellent film 413 of FIG. 11. In variation A, when the outlet edge region Ea has a circular ring shape, the outer diameter of the outlet edge region Ea is larger than the pitch of the nozzle holes H1 and H2.

Figure 13:
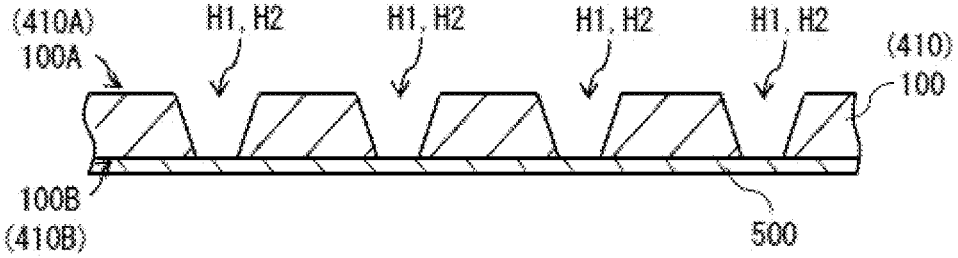
FIG. 13 is a cross sectional view representing an example of a manufacturing step of the nozzle plate shown in FIG. 11.

A method for manufacturing the nozzle plate 41 according to this variation is described below. FIG. 13 is a cross sectional view representing an example of a manufacturing step of the nozzle plate 41 according to the present variation. The method for manufacturing the nozzle plate 41 according to the present variation shares the same steps as the method for manufacturing the nozzle plate 41 according to the embodiment, except for steps after step S101 (FIGS. 10A and 10B). Accordingly, the following descriptions of the manufacturing steps begin with a step corresponding to step S102 of the method for manufacturing the nozzle plate 41 according to the embodiment.

The punching is followed by polishing (step S102). Specifically, the raised portions 100D are removed by mechanical polishing to open the indentations 100C, and form the nozzle holes H1 and H2 (FIG. 13). Here, the surface is mechanically polished in such a manner that the polished surface in the outlet edge regions Ea of the nozzle holes H1 and H2 has the surface roughness Ra1 (arithmetic mean roughness Ra) that is smaller than the surface roughness Ra2 (arithmetic mean roughness Ra) of the surrounding regions Eb around the outlet edge regions Ea (polished surface). The mechanical polishing may be performed with, for example, the tape 500 (tape polishing). In addition to forming the nozzle holes H1 and H2 in a line, the raised portions 100D are polished so that the outlet edge regions Ea (polished surface) become in contact with each other between the adjacent outlet edge regions Ea (polished surface). This is followed by formation of the liquid repellent film 413 (step S103). Specifically, the liquid repellent film 413 is formed that directly contacts the second principal surface 100B (surrounding region Eb) (FIG. 10D). This completes the nozzle plate 41 according to the present variation.

In the nozzle plate 41 according to the present variation, the outlet edge regions Ea formed in a line are in contact with each other between the adjacent outlet edge regions Ea. When the distance between the nozzle holes H1 (or the distance between the nozzle holes H2) is short, it may not be always easy to polish the surface without joining the polished surfaces because of procedural accuracy limitations. Such accuracy limitations can be overcome by allowing the polished surfaces to join together, provided that it does not cause any problem. This improves the ease of polishing. That is, the ejection quality can be maintained at a low manufacturing cost.

The method for manufacturing the nozzle plate 41 according to the present variation forms the nozzle holes H1 and H2 in a line, and polishes the raised portions 100D in such a manner that the outlet edge regions Ea (polished surfaces) become in contact with each other between the adjacent outlet edge regions Ea (polished surfaces). When the distance between the nozzle holes H1 (or the distance between the nozzle holes H2) is short, it may not be always easy to polish the surface without joining the polished surfaces because of procedural accuracy limitations. Such accuracy limitations can be overcome by allowing the polished surfaces to join together, provided that it does not cause any problem. This improves the ease of polishing. That is, the ejection quality can be maintained at a low manufacturing cost.

Variation B

Figure 14:
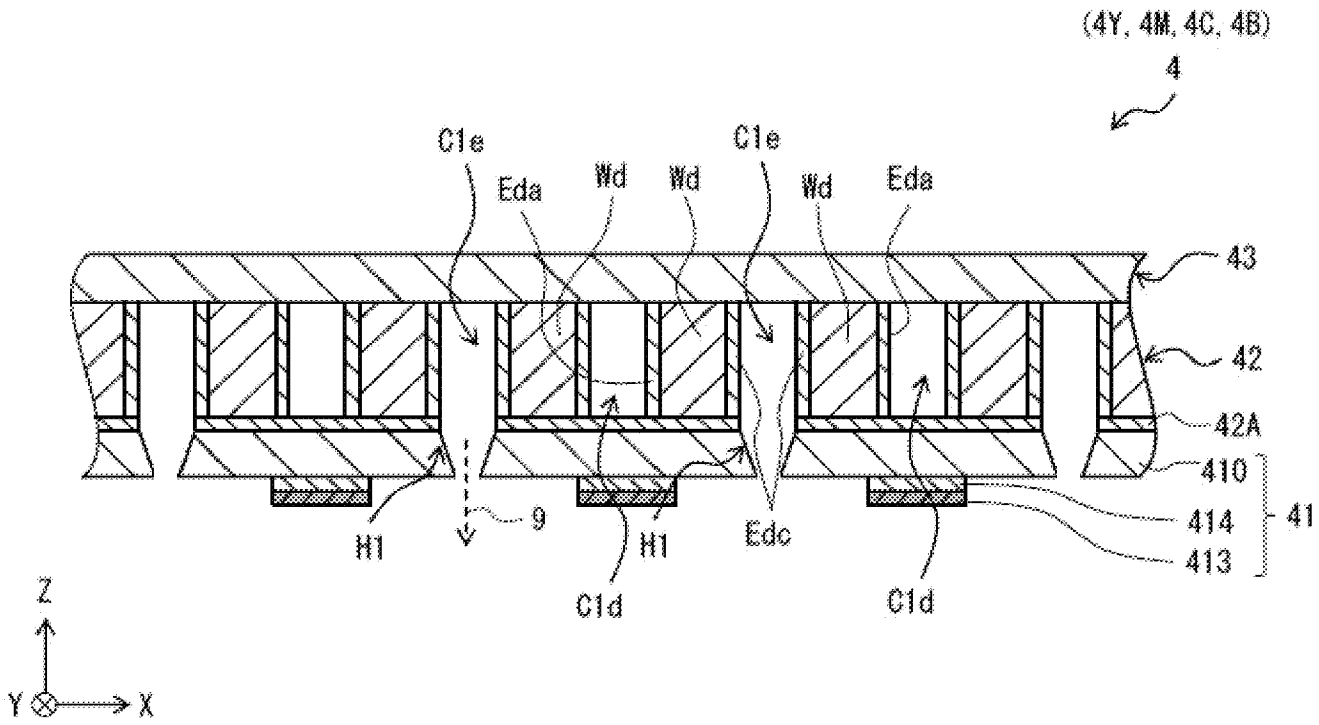
FIG. 14 is a schematic cross sectional view representing an exemplary structure of a nozzle plate according to a variation.

For example, in the foregoing embodiment and variation, the liquid repellent film 413 is in direct contact with the outlet-side principal surface 410B. However, for example, as illustrated in FIG. 14, the liquid repellent film 413 may contact the outlet-side principal surface 410B via an adhesive layer 414. The adhesive layer 414 is a layer for improving the adhesion between the outlet-side principal surface 410B (surrounding region Eb) and the liquid repellent film 413. Examples of the material of the adhesive layer 414 include diamond-like carbon (DLC), and a silane coupling agent. For manufacture of the nozzle plate 41 according to the present variation, the liquid repellent film 413 that contacts the outlet-side principal surface 410B via the adhesive layer 414 is formed after forming the adhesive layer 414 on the outlet-side principal surface 410B (surrounding region Eb).

The nozzle plate 41 according to the present variation includes the liquid repellent film 413 that contacts the outlet-side principal surface 410B via the adhesive layer 414. That is, in the present variation, the liquid repellent film 413 is in contact with the outlet-side principal surface 410B that includes the rough surrounding region Eb, via the adhesive layer 414. The liquid repellent film 413 therefore has good adhesion for the outlet-side principal surface 410B. Accordingly, the liquid repellent film 413 provided on the outlet-side principal surface 410B does not easily detach itself under the friction of wiping. With the second principal surface 100B (outlet-side principal surface 410B) protected by the liquid repellent film 413, the nozzle plate 41 can have a longer life.

The method for manufacturing the nozzle plate 41 according to the present variation forms the liquid repellent film 413 that contacts the second principal surface 100B via the adhesive layer 414. That is, in the present variation, the liquid repellent film 413 is in contact with the second principal surface 100B (outlet-side principal surface 410B) that includes the rough surrounding region Eb, via the adhesive layer 414. The liquid repellent film 413 therefore has good adhesion for the second principal surface 100B (outlet-side principal surface 410B). Accordingly, the liquid repellent film 413 provided on the second principal surface 100B (outlet-side principal surface 410B) does not easily detach itself under the friction of wiping. With the second principal surface 100B (outlet-side principal surface 410B) protected by the liquid repellent film 413, the nozzle plate 41 can have a longer life.

Other Variations

While the foregoing embodiments and variations described exemplary structures (e.g., shapes, positions, and numbers) of different members of the printer 1 and the inkjet head 4, the structures of these and other members are not limited to the ones described in the foregoing embodiments and variations, and these may have other structures, including shapes, positions, and numbers. The values and ranges of various parameters, and the relationships between these parameters described in the foregoing embodiment and variations are also not limited to the ones described in the foregoing embodiment and variations, and the parameters may have different values, ranges and relationships.

Specifically, for example, the foregoing embodiment and variations described the two-row inkjet head 4 (with two rows of nozzles 411 and 412). However, the present disclosure is not limited to this example. Specifically, for example, the inkjet head may be a single-row inkjet head (with a single row of nozzles), or an inkjet head having three or more rows (with three or more rows of nozzles).

For example, the foregoing embodiment and variations described the nozzle rows 411 and 412 extending in a straight line along X-axis direction. However, the present disclosure is not limited to this example. For example, the nozzle rows 411 and 412 may extend in an oblique direction. The shape of the nozzle holes H1 and H2 is also not limited to the circular shape described in the foregoing embodiment and variations, and may be, for example, a polygonal shape such as a triangle, or an elliptical or a star shape.

For example, the foregoing embodiment and variations described the inkjet head 4 of a side shoot-type. However, the present disclosure is not limited to this example. For example, the inkjet head 4 may be of a different type. For example, the foregoing embodiment and variations described the inkjet head 4 as a circulatory inkjet head. However, the present disclosure is not limited to this example. For example, the inkjet head 4 may be a non-circulatory inkjet head.

For example, in the foregoing embodiment and variations, the die 300 may have the single through hole 300H when the single punch 200 is used for punching. Here, the single punch 200 and the single through hole 300H work as a pair, and can form a plurality of raised portions 100D in a line by moving relative to the metal substrate 410.

The series of processes described in the foregoing embodiment and variations may be performed on hardware (circuit) or software (program). In the case of software, the software is configured as a set of programs that causes a computer to execute various functions. The program may be, for example, a preinstalled program in the computer, and may be installed afterwards in the computer from a network or a recording medium.

The foregoing embodiment and variations described the printer 1 (inkjet printer) as a specific example of a liquid jet recording apparatus of the present disclosure. However, the present disclosure is not limited to this example, and may be applied to devices and apparatuses other than inkjet printers. In other words, a liquid jet head (inkjet head 4) and a jet hole plate (nozzle plate 41) of the present disclosure may be applied to devices and apparatuses other than inkjet printers. Specifically, for example, a liquid jet head and a jet hole plate of the present disclosure may be applied to devices such as facsimile machines, and on-demand printers.

The foregoing embodiment and variations described recording paper P as a target of recording by the printer 1. However, the recording target of a liquid jet recording apparatus of the present disclosure is not limited to this example. For example, texts and patterns can be formed by jetting ink onto various materials such as a boxboard, a fabric, a plastic, and a metal. The recording target is not necessarily required to have a flat surface shape, and a liquid jet recording apparatus of the present disclosure can be used for painting and decoration of various solid objects, including, for example, food products, building materials such as tiles, furniture, and automobiles. A liquid jet recording apparatus of the present disclosure also can print on fibers, or create a solid object by jetting and solidifying ink (i.e., a 3D printer).

The examples described above may be applied in any combinations.

The effects described in the specification are merely illustrative and are not restrictive, and may include other effects.

Further, the present disclosure can also take the following configurations.

<1>

A jet hole plate for use in an liquid jet head, the jet hole plate comprising a metal substrate provided with a plurality of jet holes, the metal substrate having a principal surface provided with outlets of the jet holes, wherein, on the principal surface, a surface roughness (arithmetic mean roughness Ra) in outlet edge regions of the jet holes is smaller than that in surrounding regions around the outlet edge regions.

<2>

The jet hole plate according to <1>, wherein the outlet edge regions represent a polished surface formed by mechanical polishing.

<3>

The jet hole plate according to <1> or <2>, wherein the jet holes are formed in a line on the principal surface, and the outlet edge regions are in contact with each other between adjacent outlet edge regions.

<4>

The jet hole plate according to any one of <1> to <3>, further comprising a liquid repellent film that is in contact with the principal surface either directly or via an adhesive layer.

<5>

A liquid jet head comprising the jet hole plate according to any one of <1> to <4>.

<6>

A liquid jet recording apparatus comprising: the liquid jet head according to <5>; and a container for storing liquid to be supplied to the liquid jet head.

<7>

A method for manufacturing a jet hole plate, the method comprising: a punching step of pressing a first principal surface of a metal substrate with one or more punches to form a plurality of indentations in the first principal surface, and to form raised portions in a second principal surface of the metal substrate in positions opposite the indentations; and a polishing step of removing the raised portions by mechanical polishing to penetrate the metal substrate at the indentations to thereby form a plurality of jet holes, so that a surface roughness (arithmetic mean roughness Ra) in polished surfaces formed in outlet edge regions of the jet holes is smaller than that in surrounding regions around the polished surfaces.

<8>

The method according to <7>, wherein in the punching step, the plurality of indentations is formed in a line, and in the polishing step, the raised portions are polished so as to form the plurality of jet holes in a line, and to bring the polished surfaces into contact with each other between adjacent polished surfaces.

<9>

The method according to <7> or <8>, which further comprises a film forming step of forming a liquid repellent film that contacts the second principal surface either directly or via an adhesive layer.

What is claimed is:

1. A jet hole plate for use in an liquid jet head, the jet hole plate comprising a metal substrate provided with a plurality of jet holes, the metal substrate having a principal surface provided with outlets of the jet holes, wherein, on the principal surface, a surface roughness (arithmetic mean roughness Ra) of outlet edge regions of the jet holes is smaller than that in surrounding regions around the outlet edge regions, wherein the outlet edge regions have a circular ring shape and the outer diameter of the outlet edge regions are larger than a pitch of the jet holes, and wherein each of the outlet edge regions omnidirectionally extends around the respective jet holes.

2. The jet hole plate according to claim 1, wherein the outlet edge regions represent a polished surface formed by mechanical polishing.

3. The jet hole plate according to claim 1, wherein:

the jet holes are formed in a line on the principal surface, and the outlet edge regions are in contact with each other between adjacent outlet edge regions.

4. The jet hole plate according to claim 1, further comprising a liquid repellent film that is in contact with the principal surface either directly or via an adhesive layer.

5. A liquid jet head comprising the jet hole plate according to claim 1.

6. A liquid jet recording apparatus comprising:

the liquid jet head according to claim 5; and a container for storing liquid to be supplied to the liquid jet head.

7. A method for manufacturing a jet hole plate, the method comprising:

a punching step of pressing a first principal surface of a metal substrate with one or more punches to form a plurality of indentations in the first principal surface, and to form raised portions in a second principal surface of the metal substrate in positions opposite the indentations; and a polishing step of removing the raised portions by mechanical polishing to penetrate the metal substrate at the indentations to thereby form a plurality of jet holes, so that a surface roughness (arithmetic mean roughness Ra) of polished surfaces forming outlet edge regions of the jet holes is smaller than that in surrounding regions around the polished surfaces, wherein the outlet edge regions have a circular ring shape and the outer diameter of the outlet edge regions are larger than a pitch of the jet holes, and wherein each of the outlet edge regions omnidirectionally extends around the respective jet holes.

8. The method according to claim 7, wherein:

in the punching step, the plurality of indentations is formed in a line, and in the polishing step, the raised portions are polished so as to form the plurality of jet holes in a line, and to bring the polished surfaces into contact with each other between adjacent polished surfaces.

9. The method according to claim 7, which further comprises a film forming step of forming a liquid repellent film that contacts the second principal surface either directly or via an adhesive layer.

* * * * *